US006339432B1

(12) United States Patent
Grossman

(10) Patent No.: US 6,339,432 B1
(45) Date of Patent: Jan. 15, 2002

(54) USING ALPHA VALUES TO CONTROL PIXEL BLENDING

(75) Inventor: Mark Grossman, Palo Alto, CA (US)

(73) Assignee: Microsoft Corporation, Redmond, WA (US)

( * ) Notice: Subject to any disclaimer, the term of this patent is extended or adjusted under 35 U.S.C. 154(b) by 0 days.

(21) Appl. No.: 09/404,808

(22) Filed: Sep. 24, 1999

(51) Int. Cl.[7] ..... G09G 5/00
(52) U.S. Cl. ..... 345/639; 345/637
(58) Field of Search ..... 345/431, 435, 345/113, 634, 637, 639, 640

(56) References Cited

PUBLICATIONS

Smith, A.R. and Blinn, J.F., "Blue Screen Matting," *Computer Graphics Proceedings,* Annual Conference Series, 1996, pp. 259–268.

Woo, M. et al., *OpenGL® Programming Guide: The Official Guide to Learning OpenGL, Version 1.1,* Second Edition, Silicon Graphics, Inc., 1997, pp. 213–250 and v–xv.

Foley et al., Computer Graphics Principles and Practice, July 1997, Addison–Wesley, pp. 835 to 842.*

Jim Blinn, Compositing Part I: Theory, IEEE Computer Graphics and Applications, vol.: 4 Issue:5, Sep. 1994, pp. 83–87.*

* cited by examiner

*Primary Examiner*—Jeffery Brier
(74) *Attorney, Agent, or Firm*—Sterne Kessler Goldstein Fox P.L.L.C.

(57) ABSTRACT

A method, system, and computer program product are provided for controlling the blending of pixels using alpha values. The alpha value of a first pixel is compared to the alpha value of a second pixel. The results of the comparison are then used to choose a particular blending operation from among two or more possible blending operations that are made available. The chosen blending operation is then performed so as to produce a blended pixel. The output of the blending operation is referred to hereinafter as pixel display data and includes a set of color coordinates and an alpha value for the blended pixel. The pixel display data is then sent to a frame buffer.

18 Claims, 3 Drawing Sheets

USING ALPHA VALUES TO CONTROL PIXEL BLENDING

BACKGROUND OF THE INVENTION

1. Field of the Invention

The invention relates to computer graphics processing, and more particularly to the blending of pixels.

2. Related Art

In the course of rendering an image, two or more pixels are sometimes mapped to the same point on the display. Such pixels are referred to hereinafter as competing pixels. Competing pixels create a problem as to which pixel ought to be displayed, or whether the competing pixels ought to be blended in some manner.

If the pixels are to be blended, a further question arises as to the appropriate method of blending. In some cases, the problem of competing pixels can be resolved by data associated with the pixels. In some graphics systems, for example, pixels have an associated stencil bit which indicates whether the pixel ought to mask other competing pixels, or, conversely, whether the pixel ought to be masked by a competing pixel. A pixel may also have a Z value associated with it, which indicates the distance from the point of the pixel to the viewer. Given two competing pixels, if the first pixel has a lesser Z value than that of the second pixel, then it is meant to portray a point closer to the viewer than the second pixel. If the first pixel represents an opaque point, e.g., a point on an object through which the viewer cannot see, then the first pixel obscures the second point, and the latter is not displayed.

In other cases, stencil bits and Z values do not resolve the overlap of pixels. In some cases, the stencil bits of competing pixels may have the same value. Likewise, the Z values of the competing pixels may have the same value. Moreover, a given graphics system may not use such variables. In such situations, it may be desirable to blend the competing pixels in some manner. Where, for example, two graphics primitives such as text characters adjoin in the image plane in the course of rasterization, pixels at the edges of the two regions can overlap. Blending can make the edges appear smooth and natural.

A number of blending operations have been devised, producing different visual effects. In some blending operations, the corresponding color coordinates of the competing pixels are combined in linear fashion to yield a new set of color coordinates for display. The new red coordinate, for example would be a weighted sum of the red coordinates of the competing pixels. The new green and blue coordinates would likewise be linear sums of the green and blue coordinates of the competing pixels, respectively. In other blending operations, the new red coordinate is the minimum (or maximum) of the red coordinates of the competing pixels, and the new green and blue coordinates likewise. More common is the use of a weighting factor, often referred to as alpha, to control the amount of the competing red, green, and blue values to use. For example, to blend a new pixel over an old one, the fractional amount represented by the new alpha scales the new red, green and blue coordinates. The remainder amount, produced by subtracting the new alpha from 1.0, scales the old red, green, and blue coordinates. The two scaled colors are added, by component, to produce the replacement red, green, and blue coordinates.

In all current practices known to the inventor, a single blend function is used for all pixels unconditionally at any given time.

In any given application, however, one blending operation might be more desirable than another. In some situations, for example, a linear combination of color coordinates may be desired; in other situations, it may be more desirable to choose the maximum color coordinates from each competing pixel.

Given that several blending operations are possible, a problem arises as to how to make more than one blending operation available to an application. Moreover, if more than one blending operation is made available in a graphics processing system, an additional problem arises as to how choose the appropriate one. There is an opportunity to use a choice between blending operations that are based on a per-pixel factor other than a Z or stencil value to visualize a particular characteristic of a rendered image. Hence there is a need for a system and method for providing multiple blending operations to a graphics application, and for choosing a blending operation that will produce a desired visual effect.

SUMMARY OF THE INVENTION

The invention described herein is a method and system for controlling the blending of pixels using alpha values. The alpha value of a first pixel is compared to the alpha value of a second pixel. The results of the comparison are then used to choose one of two blending operations from among two or more possible blending operations that are made available. The chosen blending operation is then performed so as to produce a blended pixel. The output of the blending operation is referred to hereinafter as pixel display data and includes a set of color coordinates and an alpha value for the blended pixel. The pixel display data is then sent to a frame buffer.

The invention described herein has the feature of facilitating the blending of pixels that overlap.

The invention has the additional feature of being implementable in hardware, software, or a combination thereof.

The invention has the advantage of making two or more blending operations available for resolving pixel overlap.

The invention has the further advantage of using the alpha values of competing pixels to determine which blending operation to use.

BRIEF DESCRIPTION OF THE DRAWINGS

The foregoing and other features and advantages of the invention will be apparent from the following, more particular description of a preferred embodiment of the invention, as illustrated in the accompanying drawings.

DETAILED DESCRIPTION OF THE PREFERRED EMBODIMENTS

A preferred embodiment of the present invention is now described with reference to the figures where like reference numbers indicate identical or functionally similar elements. Also in the figures, the left most digit of each reference number corresponds to the figure in which the reference number is first used. While specific configurations and arrangements are discussed, it should be understood that this is done for illustrative purposes only. A person skilled in the relevant art will recognize that other configurations and arrangements can be used without departing from the spirit and scope of the invention. It will be apparent to a person skilled in the relevant art that this invention can also be employed in a variety of other devices and applications.

Contents

I. Overview
II. Terminology
III. System
IV. Method
V. Environment
VI. Conclusion

I. Overview

The invention described herein addresses the problem of how to select a blending operation to blend two or more pixels. A blending operation can be used, for example, when two or more graphics primitives have pixels that overlap in the rendering process. Given the overlap, the graphics processing system can resolve the contention by choosing and performing a blending operation. The invention uses the alpha values of the competing pixels to determine which blending operation to use. The alpha values of the competing pixels are compared and, based on the results of the comparison, a specific blending operation is chosen.

II. Terminology

The following section defines several terms that occur frequently throughout the application.

Alpha value refers to a numeric quantity associated with a pixel, typically used to indicate the opacity of the pixel. In many graphics processing systems, alpha values are fractional values ranging from zero to one.

Pixel data refers to data, associated with a pixel, that describes the properties of the pixel. Pixel data includes, but is not limited to, the color coordinates and alpha value of a pixel. If a graphics processing system uses stencil bits and Z values (see below), these are also included in the pixel data associated with a pixel.

Pixel display data refers to the pixel data produced by a blend unit for purposes of storage in a frame buffer.

Overlap, for purposes of this document, refers to a condition wherein two pixels are mapped to the same point in an image.

Destination pixel refers to a pixel whose pixel data is stored in a frame buffer.

Source pixel refers to a pixel that is produced by a rasterizer and that overlaps with a destination pixel during the rendering process.

III. System

Figure 1:
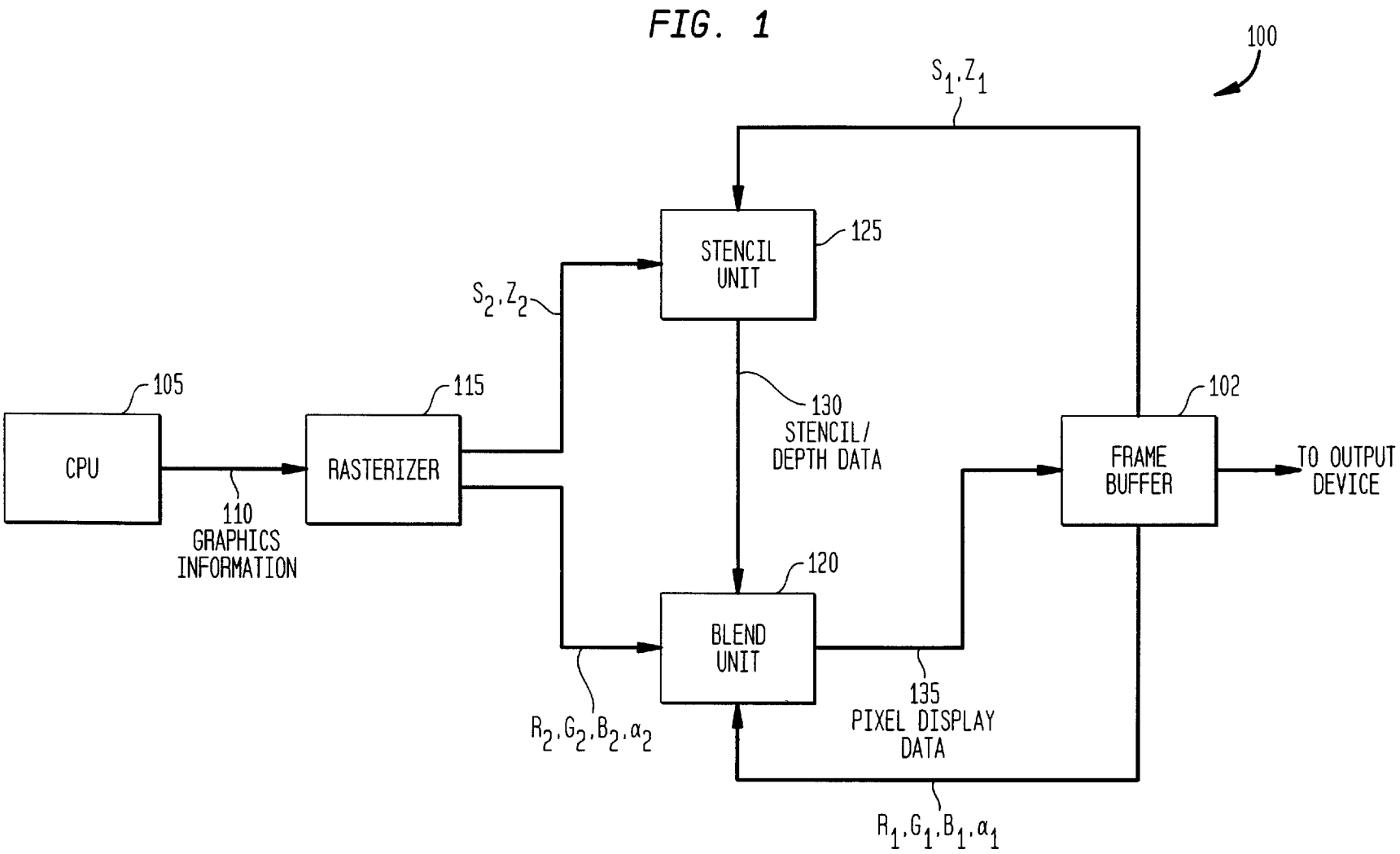
FIG. 1 is a block diagram illustrating the fundamental components and data flow within a graphics processing system incorporating the invention.

An example graphics processing system in which the invention operates is illustrated in FIG. 1. A frame buffer 102 contains information regarding pixels that have been generated by the graphics processing system, information such as the color coordinates and alpha values of generated pixels. Such data is known collectively hereinafter as pixel data. Pixels whose properties are stored in frame buffer 102 are known hereinafter as destination pixels. A given graphics processing system can represent colors in any of several coordinate schemes. Graphics processing system 100 is shown using a red/green/blue (RGB) color coordinate scheme, although the invention can work equally well in a graphics processing system that uses a different color coordinate scheme, such as cyan/magenta/yellow. The color coordinates of a destination pixel are identified in FIG. I as a red coordinate $R_1$, a green coordinate $G_1$, and a blue coordinate $B_1$. A given pixel will also have an alpha value. An alpha value is typically used to describe the opacity of a pixel and can be used to create other special effects. The alpha value of the destination pixel in system 100 is identified as $\alpha_1$. The data associated with the destination pixel can also include a stencil bit S and a Z value. The stencil bit identifies whether or not the pixel is to be masked by other competing pixels. The Z value represents the distance of the pixel from a viewer, given that the pixel will be displayed to the viewer as part of a larger object or image.

The development of pixels in addition to those already stored in frame buffer 102 begins when a central processing unit (CPU) 105 produces graphics information 110. Graphics information 110 includes graphics data and commands used in the rendering process. Graphics information 110 is sent to a rasterizer 115. Rasterizer 115 produces data which defines how each pixel is to be displayed in a two dimensional image. Rasterizer 115 may render pixels based on a description of a three-dimensional primitive such as a triangle or line. Alternatively, rasterizer 115 may produce pixels in display axis order based on a pre-generated or processed color image coming from the CPU 105 or from the frame buffer 102. For a given pixel produced by rasterizer 115, referred to hereinafter as a source pixel, the data defining the display of the pixel includes a set of color coordinates. The color coordinates of a source pixel are identified in FIG. 1 as a red coordinate $R_2$, a green coordinate $G_2$, and a blue coordinate $B_2$. For a given source pixel, rasterizer 115 also produces an alpha value identified as $\alpha_2$. The data produced by rasterizer 115 for the source pixel may also include a stencil bit identified in FIG. 1 as $S_2$, and/or a Z value, identified as $Z_2$. Rasterizer 115 sends the color coordinates and the alpha value of the source pixel to a blend unit 120. The stencil bit $S_2$ and the Z value $Z_2$ are sent by rasterizer 115 to a stencil unit 125. The color coordinates of the destination pixel, $R_1$, $G_1$, and $B_1$, are also sent to blend unit 120. Frame buffer 102 also sends the alpha value of the destination pixel, $\alpha_1$, to blend unit 120. Blend unit 120 then compares the alpha values of the source and destination pixels, $\alpha_2$ and $\alpha_1$. Based on the results of the comparison, a particular blending operation is chosen.

Note, however, that the stencil bits and the Z values of both source and destination pixels are sent to a stencil unit 125. Stencil unit 125 processes this information to produce stencil/depth data 130. The stencil/depth data 130 indicates whether either of the pixels ought to mask the other completely. Such masking is implied by the values of the stencil bits and/or by the value of the Z coordinates. Such masking would take place if, for example, an opaque object is to be shown in front of another object in a given image. If such masking is specified by the stencil bits and/or the Z values, then the competing pixels are not blended.

Blend unit 120 generates pixel display data 135 on the basis of the received color coordinates $R_1$, $G_1$, $B_1$, $R_2$, $G_2$, and $B_2$, alpha values $\alpha_1$ and $\alpha_2$, and stencil/depth data 130. Pixel display data 135 is the information defining the attributes of the blended pixel that will be displayed, such as the new color coordinates and alpha value. Pixel display data 135 is generated as a result of the chosen blending operation, subject to the stencil/depth data 130 as described above. Pixel display data 135 is then sent to frame buffer 102, overwriting the pixel display data of the destination pixel.

IV. Method

Figure 2:
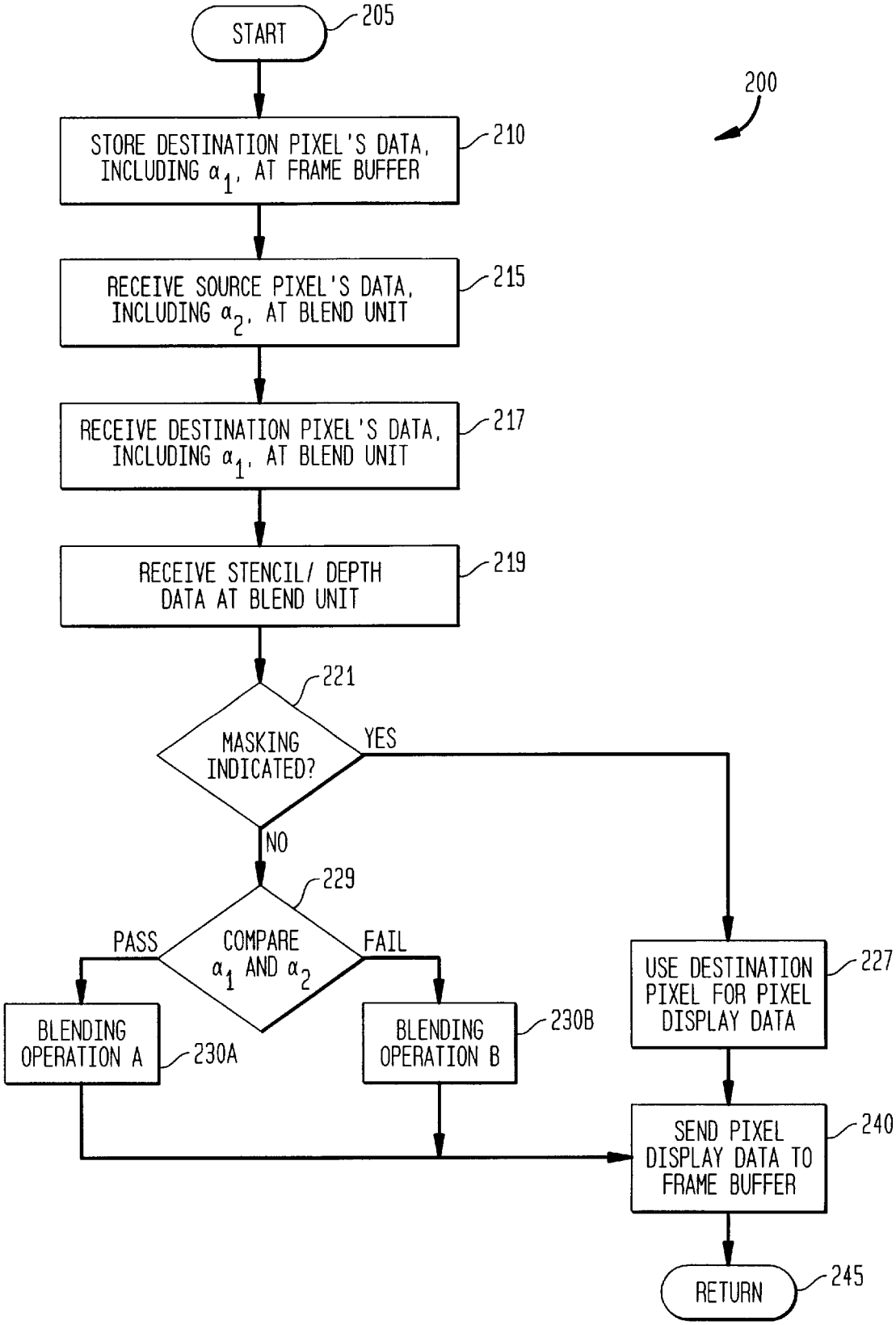
FIG. 2 is a flowchart illustrating the method of an embodiment of the invention.

The method of the invention controls the blending of pixels by means of the alpha values of the respective pixels. The process is illustrated in a flowchart 200 of FIG. 2. The process begins with a step 205. In a step 210, the pixel data associated with a destination pixel is stored at a frame buffer. As discussed above, this data includes color coordinates, an alpha value $\alpha_1$, and may also include a stencil bit and a Z value of the destination pixel. In a step 215, the color coordinates and alpha value $\alpha_2$ of a source pixel are received at a blend unit. In a step 217, the blend unit receives the color coordinates and alpha value associated with the destination pixel. At this point, therefore, the blend unit has the alpha values of both the source and destination pixels.

In a step 219, the stencil/depth data is received at the blend unit. The stencil/depth data indicates whether one of the pixels must mask the other completely, based on the stencil bits and/or the Z values of the source and destination pixels. If, in a step 221, masking of the source pixel is indicated, then the source pixel is effectively discarded. The destination pixel data is kept for use as the pixel display data in step 227. In a step 240, the pixel display data is sent to a frame buffer.

If, in step 221, masking of the source pixel is not indicated, then a blending operation must be chosen. In a step 229, $\alpha_1$ and $\alpha_2$ are compared. In an embodiment of the invention, the comparison operation determines whether $\alpha_1$ is greater than $\alpha_2$. In alternative embodiments of the invention, the comparison operation determines whether one of the alpha values exceeds the other by some threshold difference. Depending on whether the comparison test of step 229 is passed or failed, one of two different blending operations is chosen in the illustrated embodiment. If the comparison of step 229 is passed, a blending operation A is applied to the color coordinates and alpha values of the source and destination pixels in a step 230A. This produces pixel display data according to blending operation A. If the comparison of step 229 fails, a blending operation B is applied to the color coordinates and alpha values of the source and destination pixels in a step 230B. This produces pixel display data according to blending operation B. Note that in the embodiment of flowchart 200, comparison 229 has a binary result so that one of two blending operations is chosen. In other embodiments of the invention, the result of comparison 229 may not be binary. More than two blending operations may be available. For example, one blending operation may be chosen if $\alpha_1$ is greater. A second blending operation may be chosen if $\alpha_2$ is greater. A third blending operation may be chosen if $\alpha_1$ is equal to $\alpha_2$. Note that in an alternative embodiment, the comparison operation may be between $\alpha_1$ and a pre-selected constant threshold value, or between $\alpha_2$ and a pre-selected constant threshold value. In a step 240, after the chosen blending operation has been performed, the pixel display data that results from the chosen blending operation is sent to a frame buffer. The pixel display data can include an alpha value and color coordinates different from either the source or destination pixel. The process concludes with a step 245.

Note that a number of blending operations are possible, as described below. In different embodiments, blending operations 230A and 230B may be any of these, but are not limited to those described here. A blending operation can be a linear combination of corresponding color coordinates, for example. In such a blending operation, the red coordinates of the source and destination pixels are multiplied by weighting factors (assuming that RGB color representations are in use). Likewise, the respective green and blue coordinates are multiplied by weighting factors. The weighted red coordinates are then added together to produce a red coordinate of the blended pixel. Similarly, the weighted blue coordinates are added together, and the weighted green coordinates are added together, to produce the green and blue color coordinates, respectively, of the blended pixel. In some blending operations, the alpha values are used as the weighting factors.

Another possible blending operation is the use of the larger of the two competing red coordinates as the red coordinate of the blended pixel. The new red coordinate can then be expressed as the result of the maximum function, $\max(R_1, R_2)$. Likewise, the larger of the two competing green coordinates is used as the green coordinate of the blended pixel, $\max(G_1, G_2)$, and the blue coordinate of the blended pixel is $\max(B_1, B_2)$. This blending operation therefore represents a color coordinate-based maximum function. Another possible blending function is the analogous application of a color coordinate-based minimum function, so that the color coordinates of the blended pixel would be $\min(R_1, R_2)$, $\min(G_1, G_2)$, and $\min(B_1, B_2)$.

Another blending operation can simply be the adoption of one of the competing pixels as the blended pixel. Here, depending on the result of the comparison operation, the output of the blending operation is the pixel data associated with one of the competing pixels. This effectively masks the pixel not chosen.

Additional blending operations are well known in the art. Several are defined and discussed in the *OpenGL Programming Guide, Second Edition, The Official Guide to Learning OpenGL, Version* 1.1 (Mason Woo, Jackie Neider, and Tom Davis, Addison-Wesley Developers Press, 1997), pages 214–226, incorporated herein by reference.

V. Environment

Figure 3:
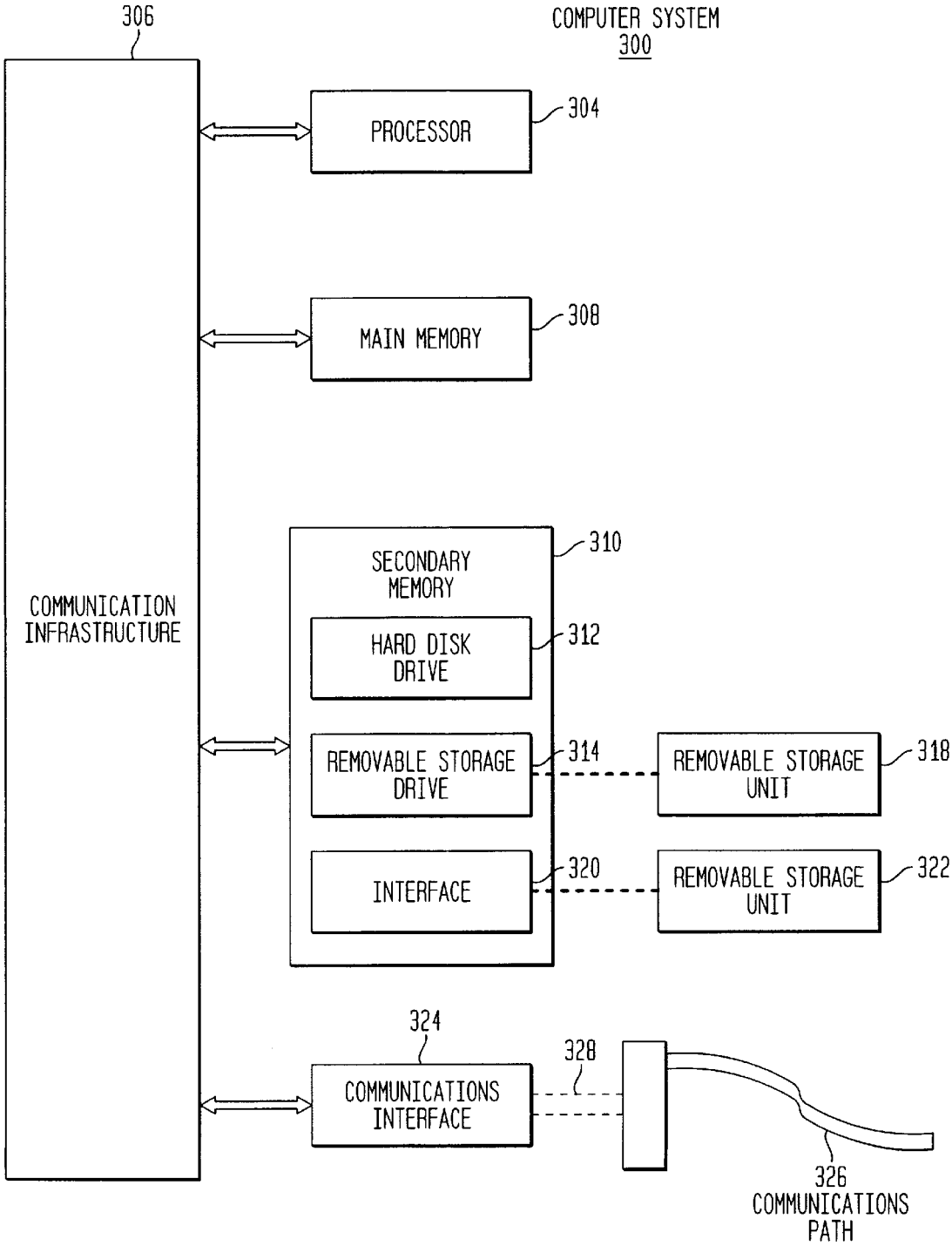
FIG. 3 is a block diagram illustrating the computing environment of the invention.

The present invention may be implemented using hardware, software or a combination thereof and may be implemented in a computer system or other processing system. An example of such a computer system 300 is shown in FIG. 3. The computer system 300 includes one or more processors, such as processor 304. The processor 304 is connected to a communication infrastructure 306, such as a bus or network). In an embodiment of the invention, processor 304 performs alpha comparison, the choice of blending operations, and the blending operations themselves, according to logic embodied in software. Various software implementations can be described in terms of this exemplary computer system. After reading this description, it will become apparent to a person skilled in the relevant art how to implement the invention using other computer systems and/or computer architectures.

Computer system 300 also includes a main memory 308, preferably random access memory (RAM), and may also include a secondary memory 310. The secondary memory 310 may include, for example, a hard disk drive 312 and/or a removable storage drive 314, representing a floppy disk drive, a magnetic tape drive, an optical disk drive, etc. The removable storage drive 314 reads from and/or writes to a removable storage unit 318 in a well known manner. Removable storage unit 318, represents a floppy disk, magnetic tape, optical disk, or other storage medium which is read (and written to) by removable storage drive 314. As will be appreciated, the removable storage unit 318 includes a computer usable storage medium having stored therein computer software and/or data.

In alternative implementations, secondary memory 310 may include other means for allowing computer programs or other instructions to be loaded into computer system 300. Such means may include, for example, a removable storage unit 322 and an interface 320. Examples of such means may include a program cartridge and cartridge interface (such as that found in video game devices), a removable memory chip (such as an EPROM, or PROM) and associated socket, and other removable storage units 322 and interfaces 320 which allow software and data to be transferred from the removable storage unit 322 to computer system 300.

Computer system 300 may also include a communications interface 324. Communications interface 324 allows software and data to be transferred between computer system 300 and external devices. Examples of communications interface 324 may include a modem, a network interface (such as an Ethernet card), a communications port, a PCMCIA slot and card, etc. Software and data transferred via communications interface 324 are in the form of signals 328 which may be electronic, electromagnetic, optical or other signals capable of being received by communications interface 324. These signals 328 are provided to communications interface 324 via a communications path (i.e., channel) 326. This channel 326 carries signals 328 and may be implemented using wire or cable, fiber optics, a phone line, a cellular phone link, an RF link and other communications channels. In an embodiment of the invention where blending operations are executed by processor 304, signals 328 that enter computer system 300 comprise the color coordinates and alpha values of the competing pixels. Moreover, the pixel display data produced by a blending operation is sent from processor 304 to a frame buffer via communications interface 324.

In this document, the terms "computer program medium" and "computer usable medium" are used to generally refer to media such as removable storage units 318 and 322, a hard disk installed in hard disk drive 312, and signals 328. These computer program products are means for providing software to computer system 300.

Computer programs (also called computer control logic) are stored in main memory 308 and/or secondary memory 310. Computer programs may also be received via communications interface 324. Such computer programs, when executed, enable the computer system 300 to implement the present invention as discussed herein. In particular, the computer programs, when executed, enable the processor 304 to implement the present invention. Accordingly, such computer programs represent controllers of the computer system 300. Where the invention is implemented using software, the software may be stored in a computer program product and loaded into computer system 300 using removable storage drive 314, hard drive 312 or communications interface 324. In an embodiment of the present invention, alpha comparison logic and blending operations are implemented in software and can therefore be made available to processor 304 through any of these means.

VI. Conclusion

While various embodiments of the present invention have been described above, it should be understood that they have been presented by way of example, and not limitation. It will be apparent to persons skilled in the relevant art that various changes in detail can be made therein without departing from the spirit and scope of the invention. Thus the present invention should not be limited by any of the above-described exemplary embodiments, but should be defined only in accordance with the following claims and their equivalents.

What is claimed is:

1. A method of controlling blending of pixels using alpha values, comprising the steps of:

(a) receiving an alpha value of a source pixel;

(b) receiving an alpha value of a destination pixel;

(c) comparing the alpha values of the source and destination pixels to form a comparison result;

(d) choosing a blending operation from among a plurality of blending operations on the basis of the comparison result;

(e) performing the chosen blending operation on color coordinates and alpha values of the source and destination pixels, to produce pixel display data; and (f) sending the pixel display data to a frame buffer.

2. The method of claim 1, wherein step (c) comprises the step of determining which alpha value is greater.

3. The method of claim 1, wherein at least one of the blending operations of step (d) comprises a linear combination of corresponding color coordinates.

4. The method of claim 3, wherein the linear combination of corresponding color coordinates comprises scaling of each color coordinate by its associated alpha value.

5. The method of claim 1, wherein at least one of the blending operations of step (d) comprises a color coordinate-based maximum function.

6. The method of claim 1, wherein at least one of the blending operations of step (d) comprises a color coordinate-based minimum function.

7. The method of claim 1, wherein at least one of the blending operations of step (d) comprises adopting the pixel data of the pixel having the greater alpha value as the pixel display data.

8. The method of claim 1, wherein at least one of the blending operations of step (d) comprises adopting the pixel data of the pixel having the lesser alpha value as the pixel display data.

9. The method of claim 1, wherein at least one of the blending operations of step (d) comprises a blending operation that operates on color coordinates that have been multiplied by respective blend factors.

10. A system for controlling blending of pixels using alpha values, comprising:

first alpha value receiving apparatus for receiving an alpha value of a first pixel;

second alpha value receiving apparatus for receiving an alpha value of a second pixel;

comparing logic for comparing said alpha values of said first and second pixels to form a comparison result;

choosing logic for choosing a blending operation from among a plurality of blending operations on the basis of said comparison result;

a plurality of blending logic for blending color coordinates and said alpha values of said first and second pixels, to produce pixel display data; and sending apparatus for sending said pixel display data to a frame buffer.

11. The system of claim 10, wherein said plurality of blending logic comprises linear combining logic for performing linear combination of corresponding color coordinates.

12. The system of claim 11, wherein said linear combining logic comprises weighting logic for weighting of each color coordinate by its associated alpha value.

13. The system of claim 10, wherein said plurality of blending logic comprises maximum color coordinate selecting logic for performing a color coordinate-based maximum function.

14. The system of claim 10, wherein said plurality of blending logic comprises minimum color coordinate selecting logic for performing a color coordinate-based minimum function.

15. The system of claim 10, wherein said plurality of blending logic comprises maximum alpha adopting logic for adopting the pixel data of the pixel having the greater alpha value as the pixel display data.

16. The system of claim 10, wherein said plurality of blending logic comprises minimum alpha adopting logic for adopting the pixel data of the pixel having the lesser alpha value as the pixel display data.

17. The system of claim 10, wherein said plurality of blending logic comprises blend factor multiplication logic for multiplying color coordinates by blend factors.

18. A computer program product comprising a computer usable medium having computer readable program code embodied in said medium, where the computer readable program executes on a computer that controls blending of pixels using alpha values, said computer readable program code comprising:

(a) first computer readable program code logic for causing the computer to compare the alpha values of the first and second pixels to form a comparison result;

(b) second computer readable program code logic for causing the computer to choose a blending operation from among a plurality of blending operations on the basis of the comparison result, to identify a chosen blending operation;

(c) third computer readable program code logic for causing the computer to perform the chosen blending operation on color coordinates and alpha values of the first and second pixels, to produce pixel display data; and (d) fourth computer readable program code logic for causing the computer to send the pixel display data to a frame buffer.

* * * * *